US010516928B2

(12) United States Patent
Briggs

(10) Patent No.: US 10,516,928 B2
(45) Date of Patent: Dec. 24, 2019

(54) WEARABLE AUDIO DEVICE HAVING EXTERNAL ANTENNA AND RELATED TECHNOLOGY

(71) Applicant: New Audio LLC, New York, NY (US)

(72) Inventor: Drew Stone Briggs, Seattle, WA (US)

(73) Assignee: New Audio LLC, New York, NY (US)

( * ) Notice: Subject to any disclaimer, the term of this patent is extended or adjusted under 35 U.S.C. 154(b) by 190 days.

(21) Appl. No.: 15/650,799

(22) Filed: Jul. 14, 2017

(65) Prior Publication Data

US 2018/0020277 A1 Jan. 18, 2018

Related U.S. Application Data

(60) Provisional application No. 62/363,132, filed on Jul. 15, 2016.

(51) Int. Cl.

| | |
|---|---|
| ***H04R 1/10*** | (2006.01) |
| ***H01Q 1/27*** | (2006.01) |
| ***H01Q 1/44*** | (2006.01) |

(52) U.S. Cl.

CPC ..... *H04R 1/1008* (2013.01); *H01Q 1/44* (2013.01); *H04R 1/105* (2013.01); *H04R 1/1016* (2013.01); *H04R 1/1066* (2013.01); *H04R 1/1075* (2013.01); *H04R 2420/07* (2013.01)

(58) Field of Classification Search

CPC .... H04R 1/1008; H04R 1/105; H04R 1/1075; H04R 1/1066; H04R 1/1016; H04R 2420/07; H01Q 1/273; H01Q 9/42; H01Q 9/065; H01Q 9/0421; H01Q 1/44

USPC ..... 381/384

See application file for complete search history.

(56) References Cited

U.S. PATENT DOCUMENTS

| | | | | |
|---|---|---|---|---|
| 6,980,165 | B2 * | 12/2005 | Yuasa | H01Q 1/273 343/718 |
| 7,146,004 | B2 * | 12/2006 | Bodley | H04M 1/05 379/430 |
| 8,094,859 | B2 * | 1/2012 | Suematsu | H01Q 1/273 379/430 |
| 9,106,986 | B2 * | 8/2015 | Shen | H04R 3/00 |
| 9,917,940 | B2 * | 3/2018 | Broadley | H04M 1/6058 |
| 9,972,895 | B2 * | 5/2018 | Hirsch | H01Q 1/273 |
| 2005/0266875 | A1 * | 12/2005 | Yegin | H01Q 1/273 455/552.1 |
| 2012/0093334 | A1 * | 4/2012 | Schreuder | H04R 1/1033 381/74 |
| 2016/0079660 | A1 * | 3/2016 | Bevelacqua | H01Q 1/273 343/702 |

(Continued)

*Primary Examiner* — Oyesola C Ojo

(74) *Attorney, Agent, or Firm* — Perkins Coie LLP

(57) ABSTRACT

A wearable audio device in accordance with a particular embodiment of the present technology includes an earpiece, a speaker, an antenna, and processing circuitry. The earpiece includes a housing within which the speaker and the processing circuitry are disposed. The antenna conformably extends along a perimeter portion of the housing. The processing circuitry is configured to receive audio content from an audio player via the antenna. The processing circuitry is also configured to generate sound corresponding to the audio content via the speaker. The antenna is exposed and is not a loop antenna. The audio device also includes a circuit board supporting at least some of the processing circuitry within the housing. The audio content travels from the antenna to the circuit board without travelling through any flexible wires.

26 Claims, 7 Drawing Sheets

(56) References Cited

U.S. PATENT DOCUMENTS

| | | | | |
|---|---|---|---|---|
| 2017/0201821 | A1* | 7/2017 | McAuliffe | H01Q 1/22 |
| 2017/0257692 | A1* | 9/2017 | Yang | H04R 1/1041 |
| 2017/0295420 | A1* | 10/2017 | Yeung | H01Q 1/273 |
| 2017/0353781 | A1* | 12/2017 | Choi | H04R 1/1016 |

* cited by examiner

WEARABLE AUDIO DEVICE HAVING EXTERNAL ANTENNA AND RELATED TECHNOLOGY

CROSS-REFERENCE TO RELATED APPLICATION INCORPORATED BY REFERENCE

This application claims the benefit of U.S. Provisional Application No. 62/363,132, filed Jul. 15, 2016, which is incorporated herein by reference in its entirety. To the extent the foregoing application or any other material incorporated herein by reference conflicts with the present disclosure, the present disclosure controls.

TECHNICAL FIELD

The present technology is related to wearable audio devices, such as audio devices including ear-supported or head-supported earpieces.

BACKGROUND

Wearable audio devices typically include an earpiece configured to be worn at or near a user's ear. The earpiece can include a speaker that converts an audio signal into sound. Because the sound is generated in close proximity to a user's ear, the sound is fully audible to the user while still being inaudible or minimally audible to others around the user. For this reason, wearable audio devices are well-suited for use in public settings. Some wearable audio devices include one or two ear-supported earpieces. Examples of ear-supported earpieces include earpieces including earbuds shaped to extend into a user's ear canal and earpieces including hooks shaped to extend over a user's auricle. Other wearable audio devices include one or two head-supported earpieces. Examples of head-supported earpieces include earpieces at opposite respective ends of a headpiece shaped to bridge a user's head. Ear-supported and head-supported earpieces can be wired or wireless. Wired earpieces receive audio content from an audio player via a wire. Wireless earpieces receive audio content from an audio player via Bluetooth or a similar wireless communication standard. In a wearable audio device including a wireless earpiece, the wireless earpiece may still be connected to another earpiece or to a control element via a wire.

In the context of wearable audio devices, fidelity is often a key measure of performance. Consumers demand wearable audio devices that play music and other types of audio content with little or no interference, such as skips, noise, static, and crackling. Achieving high fidelity in a wireless earpiece is more challenging than achieving high fidelity in a wired earpiece. This is because an audio signal in a wired connection is received directly, whereas an audio signal in a wireless connection is received via an antenna. The antennas in conventional wearable audio devices having wireless earpieces are commonly known to be prone to interference. Correspondingly, the fidelity of conventional wearable audio devices having wireless earpieces is commonly known to be poor, and these devices have not yet achieved significant market penetration. In addition to fidelity, however, consumers demand convenient form factors that are inconsistent with use of wires. Accordingly, there is a need for innovation that, for example, allows the high fidelity conventionally associated with wearable audio devices having wired earpieces to be realized together with the convenient form factors conventionally associated with wearable audio devices having wireless earpieces.

BRIEF DESCRIPTION OF THE DRAWINGS

Many aspects of the present technology can be better understood with reference to the following drawings. The components in the drawings are not necessarily to scale. Instead, emphasis is placed on illustrating clearly the principles of the present technology. For ease of reference, throughout this disclosure identical reference numbers may be used to identify identical, similar, or analogous components or features of more than one embodiment of the present technology.

DETAILED DESCRIPTION

Figure 1:
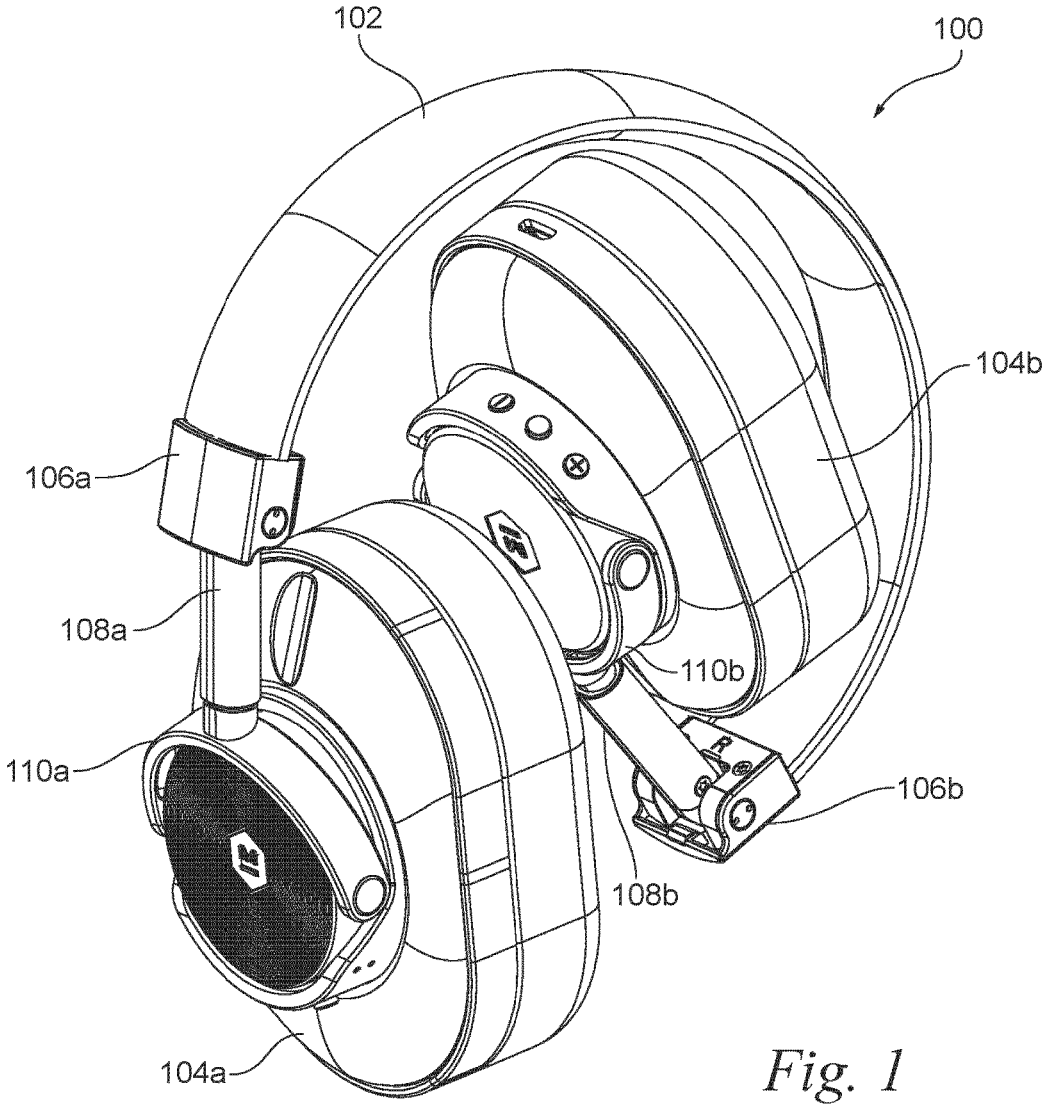
FIG. 1 is a perspective view of a wearable audio device in accordance with an embodiment of the present technology.

Conventional wearable audio devices having wireless earpieces typically include an antenna mounted directly to an internal circuit board. This conventional approach to antenna placement is compact and low cost, but has significant disadvantages. As one example, a conventional antenna mounted to an internal circuit board may be susceptible to interference from other electronics mounted to the circuit board or otherwise positioned at or near the circuit board. As another example, placement of a circuit board may be influenced by design considerations different than (and potentially at odds with) design considerations influencing placement of an antenna. Accordingly, a conventional antenna mounted to an internal circuit board may have suboptimal positioning for reducing interference, such as positioning that locates the antenna near a user's head and/or near another external source of interference. As yet another example, a housing around a conventional antenna mounted to an internal circuit board may need to be made of a material transparent to radiofrequency (RF) waves for the antenna to function properly. This may be undesirable when aesthetic or other considerations favor use of a housing made of metal or another material that obstructs transmission of RF waves.

Wearable audio devices and related devices, systems, and methods in accordance with embodiments of the present technology can at least partially address one or more of the foregoing and/or other problems associated with conventional technologies. For example, wearable audio devices in accordance with at least some embodiments of the present technology include innovative antennas that can be positioned relatively far from internal and external sources of interference and variability. This can enhance the short-range RF communication fidelity of these audio devices. Furthermore, wearable audio devices in accordance with at least some embodiments of the present technology are compatible with metal and other housing materials that tend to obstruct transmission of RF waves. Other advantages over conventional counterparts in addition to or instead of the foregoing advantages also may be present.

A wearable audio device in accordance with a particular embodiment of the present technology includes an earpiece and an antenna conformably extending along a perimeter portion of a housing of the earpiece. The antenna can be spaced apart and/or shielded from internal and external sources of interference and variability. These sources include, for example, internal wires that may shift over time (e.g., due to routine handling of the audio device) and thereby cause the RF-receiving characteristics of the antenna to be different than they were when the audio device was originally manufactured and tuned. In at least some cases, the antenna is external, which may allow the antenna to communicate wirelessly with an audio player even when a housing of an earpiece including the antenna is made of metal or another material that tends to interfere with transmission of RF waves. Unlike handheld electronic devices, wearable audio devices tend to be handled infrequently (if at all) during use. Accordingly, the antenna may be of a type that is susceptible to interference from handling, but that has other advantages relative to types of antennas that are less susceptible to interference from handling. For example, the antenna can be a monopole antenna or a dipole antenna having independent positive and negative antenna elements. Antennas of these and other suitable types may be relatively susceptible to interference from handling, but may offer better performance (e.g., greater range) than loop antennas and/or other types of antennas that are less susceptible to interference from handling.

The inventors further recognized that one technical challenge associated with locating an antenna separately from a circuit board in a wearable audio device is that an electrical connection between the antenna and the circuit board has the potential to cause slight changes in the RF-receiving characteristics of the antenna over time. For example, when an external antenna and an internal circuit board are connected via a flexible wire, slight shifting of the wire over time (as described above with respect to other internal wires) may cause the RF-receiving characteristics of the antenna to be different than they were when the audio device was originally manufactured and tuned. Unlike other potential sources of interference and variability (e.g., other internal wires), an electrical connection between an antenna and a circuit board is intimately associated with the antenna. It is difficult, therefore, to mitigate the impact of this interference and variability by spacing apart the antenna and the electrical connection or by shielding the antenna from the electrical connection. The inventors recognized, however, that use of certain types of electrical connections between antennas and circuit boards may reduce or eliminate this problem. In a wearable audio device configured in accordance with a particular embodiment of the present technology, audio content travels from an external antenna to an internal circuit board without travelling through any flexible wires. Instead, the audio content may travel through a rigid lead, an angled plate, a pin connector, or another suitable type of electrical connector having a position that is relatively consistent over time.

Specific details of wearable audio devices and related devices, systems, and methods in accordance with several embodiments of the present technology are described herein with reference to FIGS. 1-13. Although wearable audio devices and related devices, systems, and methods may be disclosed herein primarily or entirely in the context of dual-earpiece audio devices, contexts in addition to those disclosed herein are within the scope of the present technology. For example, suitable features of described dual-earpiece audio devices can be implemented in the context of single-earpiece audio devices. Furthermore, it should understood, in general, that other devices, systems, and methods in addition to those disclosed herein are within the scope of the present technology. For example, devices, systems, and methods in accordance with embodiments of the present technology can have different and/or additional configurations, components, and procedures than those disclosed herein. Moreover, a person of ordinary skill in the art will understand that devices, systems, and methods in accordance with embodiments of the present technology can be without one or more of the configurations, components, and/or procedures disclosed herein without deviating from the present technology.

FIG. 1 is a perspective view of a wearable audio device 100 in accordance with an embodiment of the present technology. The audio device 100 can include an arcuate headpiece 102 configured to fit over a user's head. The audio device 100 can further include opposing earpieces 104 (individually identified as earpieces 104*a*, 104*b*) operably connected to opposite respective ends of the headpiece 102. For example, the audio device 100 can include a hinge 106*a*, a telescoping arm 108*a*, and a yoke 110*a* connected in series from one end of the headpiece 102 to the earpiece 104*a*. Similarly, the audio device 100 can include a hinge 106*b*, a telescoping arm 108*b*, and a yoke 110*b* connected in series from the opposite end of the headpiece 102 to the earpiece 104*b*. In FIG. 1, the hinge 106*a* is shown extended such that the earpiece 104*a* is in an extended state, and the hinge 106*b* is shown folded such that the earpiece 104*b* is in a folded state. When in use by a user, the earpieces 104*a*, 104*b* can be in their respective extended states.

Figure 2:
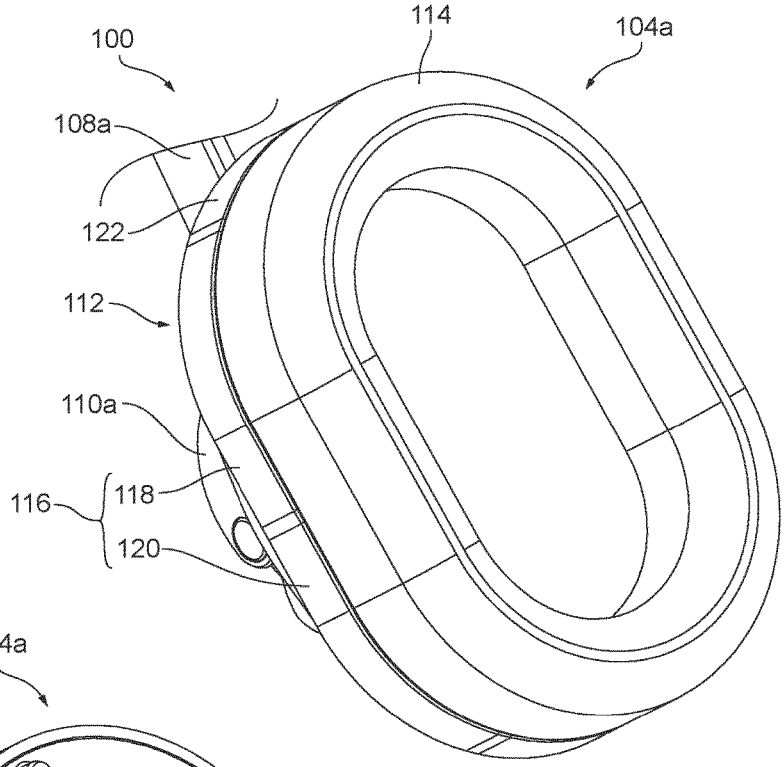
FIG. 2 is a perspective view of a head-supported earpiece of the audio device shown in FIG. 1.

FIG. 2 is a perspective view of the earpiece 104*a*. The earpiece 104*a* can include a housing 112 shaped as a shallow ovoid prism, and a pad 114 overlying the housing 112. The pad 114 can be positioned to be between the housing 112 and a user's ear when the user wears the audio device 100. In at least some cases, the earpiece 104*a* is configured to cover at least half of a user's ear when the user wears the audio device 100. The earpiece 104*a* can further include an antenna 116 conformably extending along a perimeter portion of the housing 112. The antenna 116 can be exposed, as illustrated, or underlying another structure at the perimeter portion of the housing 112. In the illustrated embodiment, the antenna 116 is a dipole antenna including an independent positive antenna element 118 and an independent negative antenna element 120. In other embodiments, a counterpart of the antenna 116 can be a monopole antenna or an antenna of another suitable type. With reference again to FIG. 2, the earpiece 104*a* can include a rim 122 at a region of the perimeter portion of the housing 112 not occupied by the positive and negative antenna elements 118, 120. The rim 122 and the positive and negative antenna elements 118, 120 can be similar or the same in composition (e.g., metal), transverse cross-sectional shape, and/or transverse cross-sectional size. This can give the perimeter portion of the housing 112 a uniform overall appearance.

The positive and negative antenna elements 118, 120 can be disposed (e.g., symmetrically disposed) at opposite respective sides of a horizontal plane that exactly bisects the earpiece 104*a* or is vertically offset from exactly bisecting the earpiece 104*a* by less than 10% of a total height of the earpiece 104*a* when a user wears the audio device 100. Furthermore, most (e.g., at least 75%) of a total exposed surface area of the antenna 116 can be at one or the other side of a vertical plane that exactly bisects the earpiece 104*a* or is horizontally offset from exactly bisecting the earpiece 104*a* by less than 10% of a total width of the earpiece 104*a* when a user wears the audio device 100. These and/or other aspects of the positioning of antenna 116 can be selected to reduce or eliminate the impact of certain types of variability on the RF-receiving characteristics of the antenna 116. For example, the antenna 116 can be well spaced from a downward-facing port (not shown) and from an upward-facing portion of the housing 112 nearest to the arm 108*a*. The port can be a source of interference and variability, for example, because it may or may not be coupled to a plug during normal operation of the audio device 100. The arm 108*a* can be a source of interference and variability, for example, because it can have different levels of extension and different rotational positions about the hinge 106*a* during normal operation of the audio device 100.

Figure 3:
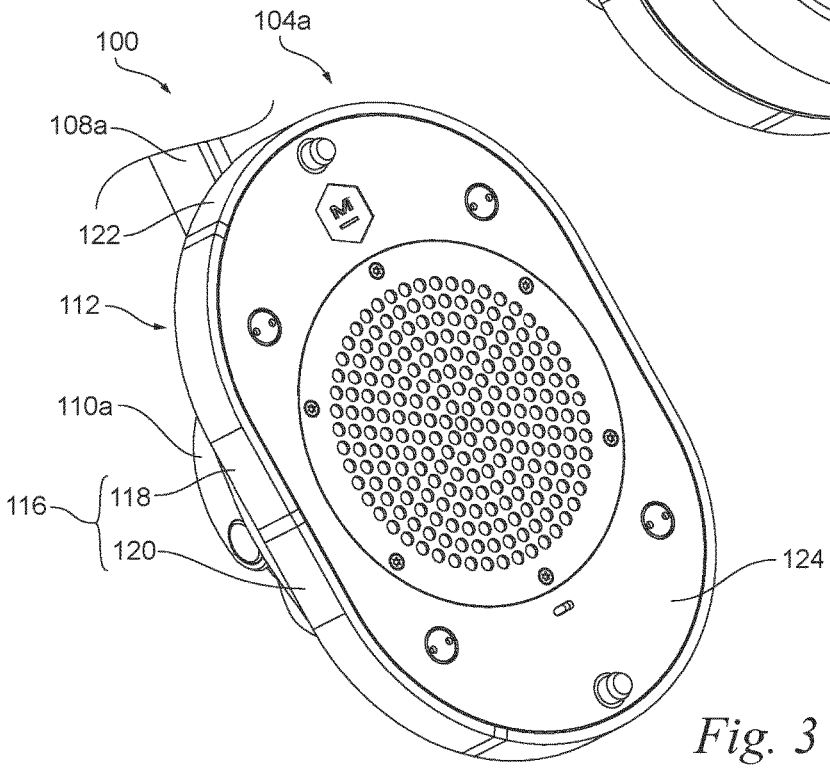
FIG. 3 is a perspective view of the earpiece of the audio device shown in FIG. 1 with a pad of the earpiece removed.
Figure 4:
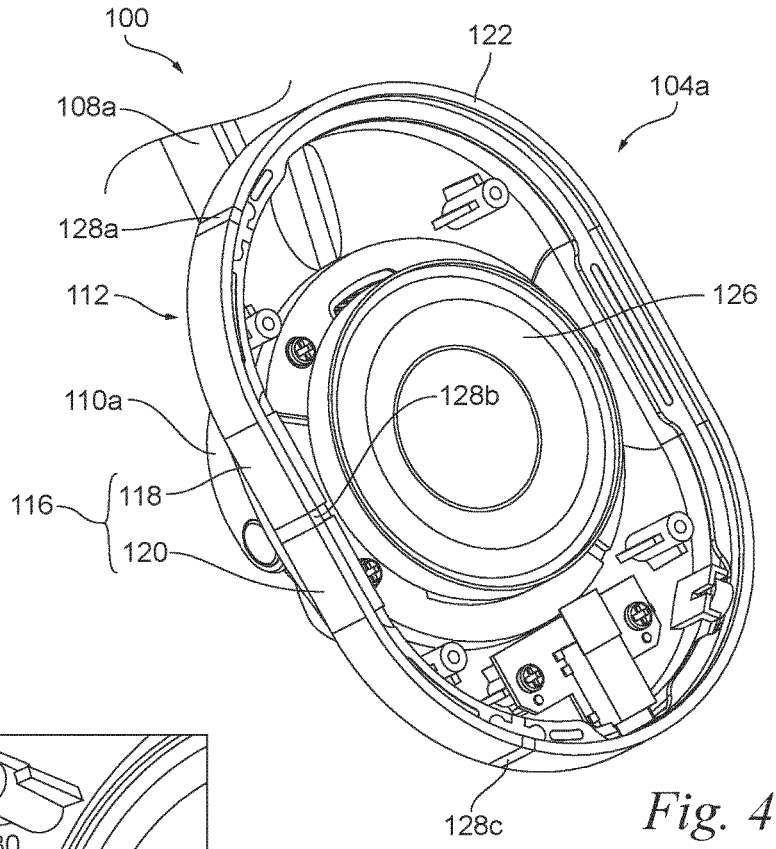
FIG. 4 is a perspective view of the earpiece of the audio device shown in FIG. 1 with the pad and a plate of the earpiece removed.

FIG. 3 is a perspective view of the earpiece 104*a* with the pad 114 (FIG. 2) removed. As shown in FIG. 3, the earpiece 104*a* can include a rigid plate 124 underlying the pad 114. FIG. 4 is a perspective view of the earpiece 104*a* with both the pad 114 (FIG. 2) and the plate 124 (FIG. 3) removed. As shown in FIG. 4, the earpiece 104*a* can include a speaker 126 underlying the plate 124. With reference to FIGS. 2-4 together, when the earpiece 104*a* is fully assembled, the speaker 126 can be within the housing 112, and the plate 124 can be between the speaker 126 and the pad 114. As shown in FIG. 4, the earpiece 104*a* can include dielectric spacers 128 (individually identified as dielectric spacers 128*a*-128*c*) at the perimeter portion of the housing 112. The dielectric spacers 128 can electrically separate the positive and negative antenna elements 118, 120 from one another and from the rim 122. For example, the dielectric spacer 128*a* can be disposed between the positive antenna element 118 and one end of the rim 122; the dielectric spacer 128*b* can be disposed between the positive antenna element 118 and the negative antenna element 120; and the dielectric spacer 128*c* can be disposed between the negative antenna element 120 and an opposite end of the rim 122.

Figure 5:
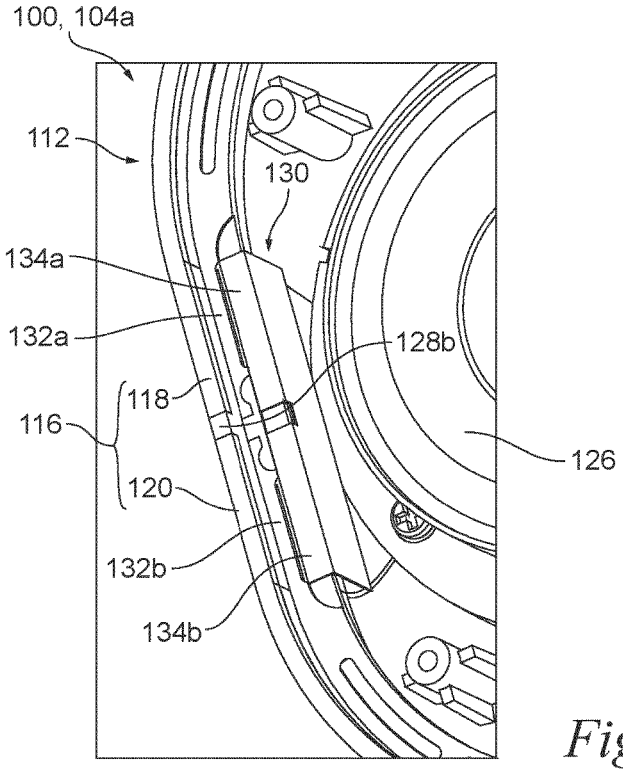
FIG. 5 is an enlarged perspective view of a portion of the earpiece of the audio device shown in FIG. 1 with the pad and the plate removed.

FIG. 5 is an enlarged perspective view of a portion of the earpiece 104*a* with the pad 114 (FIG. 2) and the plate 124 (FIG. 3) removed. As shown in FIG. 5, the audio device 100 can include a circuit board 130 within the housing 112. The circuit board 130 can at least partially support processing circuitry configured to receive audio content via the antenna 116 over one or more short-range RF bands. The processing circuitry can also be configured to generate sound corresponding to the audio content via the speaker 126. In at least some cases, the audio content travels from the antenna 116 to the circuit board 130 without travelling through any flexible wires. For example, the audio device 100 can include rigid leads 132 (individually identified as leads 132*a*, 132*b*) extending between the antenna 116 and the circuit board 130. The circuit board 130 can include antenna contacts 134 (individually identified as antenna contacts 134*a*, 134*b*) through which the antenna 116 is electrically connected to the processing circuitry. In particular, the positive antenna element 118 can be electrically connected to the processing circuitry via the lead 132*a* and the antenna contact 134*a*. Similarly, the negative antenna element 120 can be electrically connected to the processing circuitry via the lead 132*b* and the antenna contact 134*b*. In the illustrated embodiment, the circuit board 130 is flexible and configured to contact the leads 132 directly. In other embodiments, a counterpart of the circuit board 130 can be rigid and/or configured to contact counterparts of the leads 132 indirectly.

Figure 6:
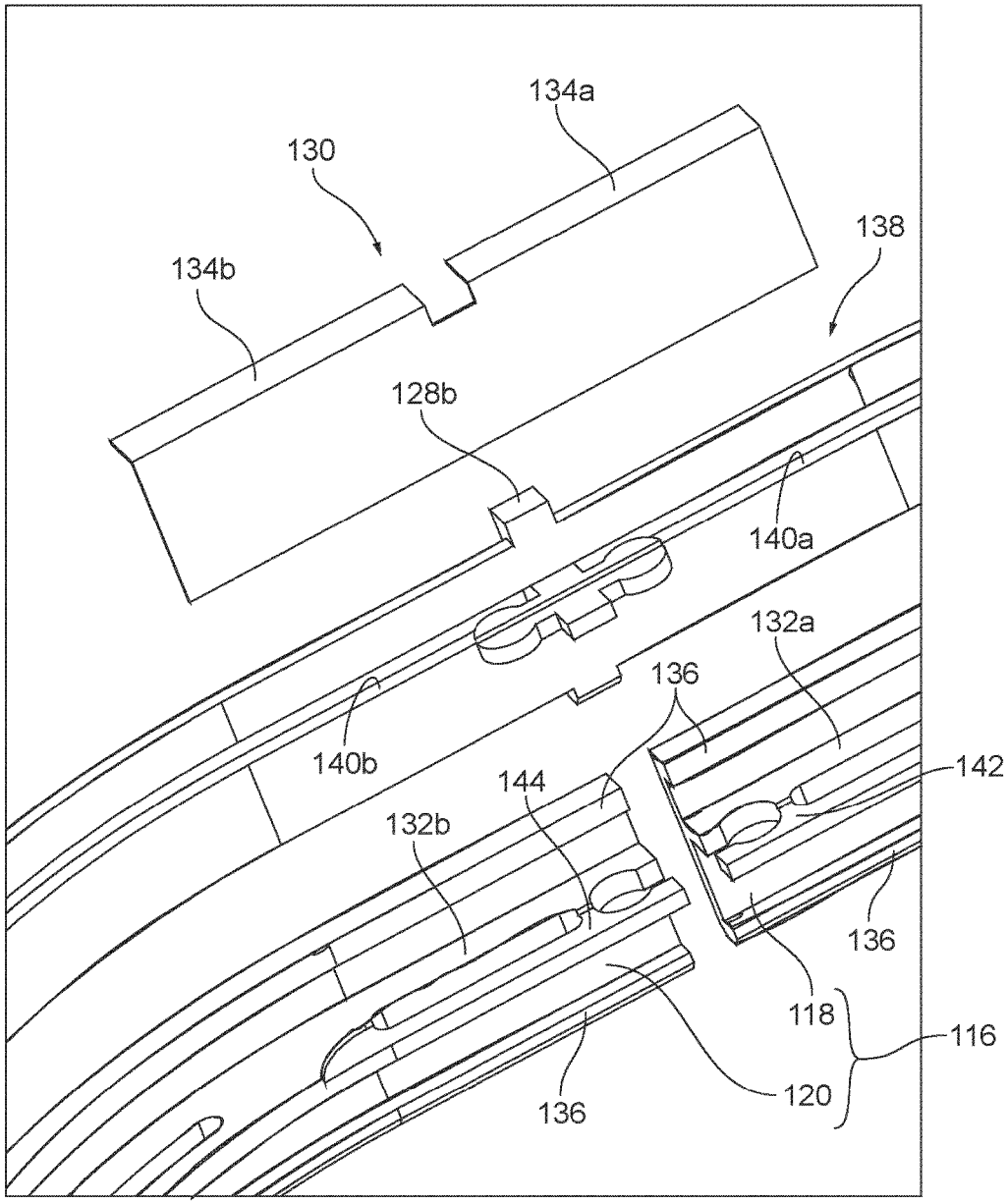
FIG. 6 is an exploded perspective view of selected components of the audio device shown in FIG. 1.

FIG. 6 is an exploded perspective view of selected components of the audio device 100. With reference to FIGS. 5 and 6 together, the leads 132*a*, 132*b* can be shaped as flanges projecting inwardly from the positive and negative antenna elements 118, 120, respectively. The antenna 116 can include inwardly extending lips 136 parallel to and spaced apart from the leads 132. The audio device 100 can include a dielectric liner 138 having slots 140*a*, 140*b* through which the leads 132*a*, 132*b* extend, respectively. The dielectric liner 138 can also carry the dielectric spacers 128. When the earpiece 104*a* is fully assembled, portions of the dielectric liner 138 between the dielectric spacers 128 can be snuggly disposed between the leads 132 and the lips 136. This general configuration can continue throughout the perimeter portion of the housing 112, including along the rim 122 (FIG. 4). As shown in FIGS. 5 and 6, the lead 132*a* can include a first inset 142 shaped to receive the antenna contact 134*a*. Similarly, the lead 132*b* can include a second inset 144 shaped to receive the antenna contact 134*b*. When the earpiece 104*a* is fully assembled, the antenna contacts 134*a*, 134*b* can be clamped to the leads 132*a*, 132*b*, respectively. For example, the antenna contacts 134*a*, 134*b* can be clamped between the plate 124 (FIG. 3) and the leads 132*a*, 132*b*, respectively.

Figure 7:
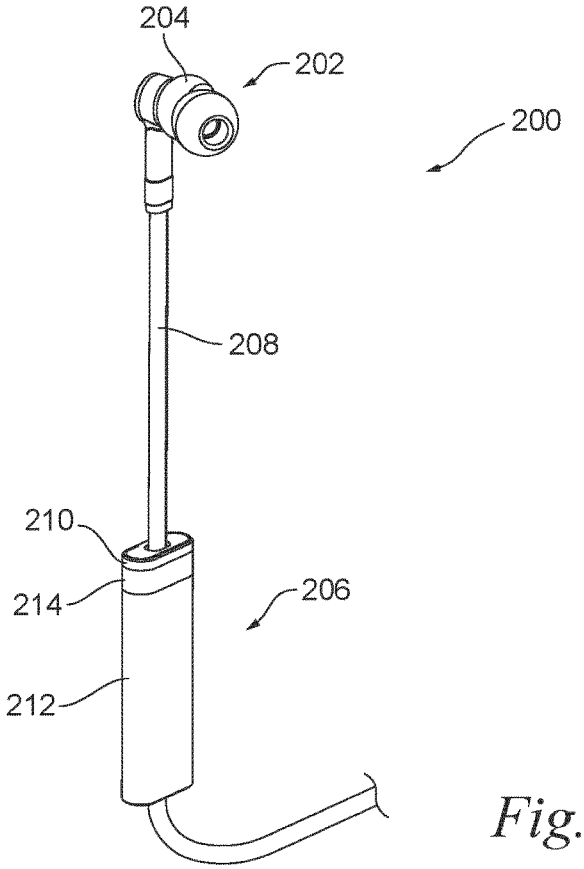
FIG. 7 is a perspective view of a portion of a wearable audio device in accordance with another embodiment of the present technology.

FIG. 7 is a perspective view of a portion of a wearable audio device 200 in accordance with another embodiment of the present technology. The audio device 200 can include an earpiece 202 configured to be at least partially received within a user's ear canal when the user wears the audio device 200. A snug fit between the earpiece 202 and a user's ear canal can hold the earpiece 202 in position when the user wears the audio device 200 in a hands-free state. The earpiece 202 can include first housing 204 containing a speaker (not shown). The audio device 200 can further include a second housing 206 and a flexible cord 208 extending between the earpiece 202 and the second housing 206. The second housing 206 can be positioned to be below the earpiece 202 when a user wears the audio device 200 in a hands-free state. The audio device 200 can further include an exposed antenna 210 conformably extending along a perimeter portion of the second housing 206. The second housing 206 can include a casing 212 and a dielectric spacer 214 between the antenna 210 and the casing 212. In the illustrated embodiment, the antenna 210 is a monopole antenna. In other embodiments, a counterpart of the antenna 210 can be a dipole antenna or an antenna of another suitable type.

Figure 8:
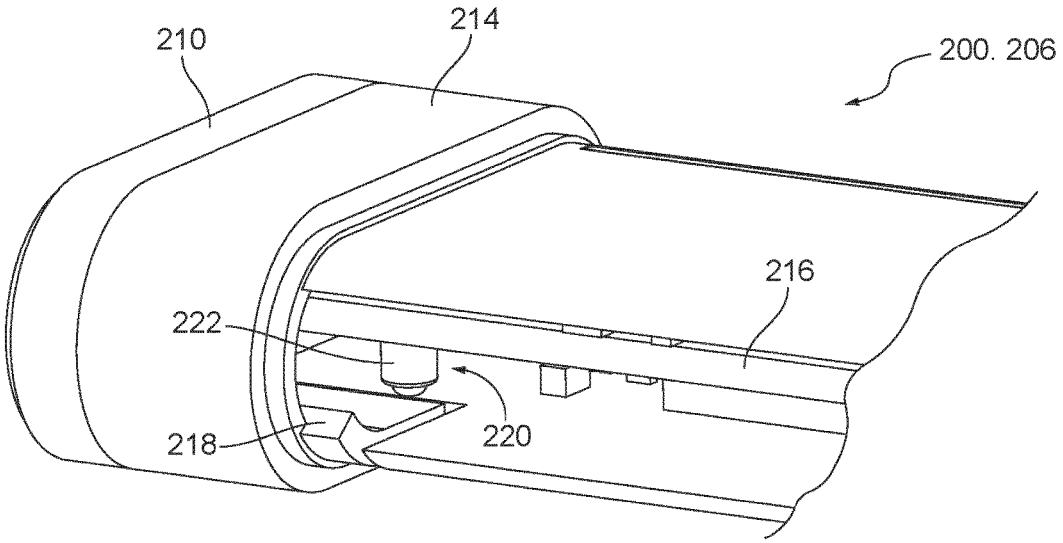
FIG. 8 is an enlarged perspective view of a portion of a housing of the portion of an audio device shown in FIG. 7 with a casing of the housing removed.

FIG. 8 is an enlarged perspective view of a portion of the second housing 206 with the casing 212 removed. As shown in FIG. 8, the audio device 200 can include a rigid circuit board 216 within the second housing 206. The circuit board 216 can at least partially support processing circuitry configured to receive audio content via the antenna 210 over one or more short-range RF bands. The processing circuitry can also be configured to generate sound corresponding to the audio content via the cord 208 and via the speaker within the first housing 204. As with the audio device 100 described above, audio content can travel within the audio device 200 from the antenna 210 to the circuit board 216 without travelling through any flexible wires. The audio device 200 can include a lead 218 that projects downward from the antenna 210 when a user wears the audio device 200. To span a gap between the circuit board 216 and the lead 218, the audio device 200 can include a pin connector 220 (e.g., a pogo pin) having a pin 222 and a spring (not shown) configured to resiliently urge the pin 222 from a retracted position toward an extended position. The circuit board 216 can include an antenna contact (not shown) directly connected to the pin connector 220. Thus, the antenna 210 and the circuit board 216 can be electrically connected via the lead 218, the pin connector 220, and the antenna contact in series.

Figure 9:
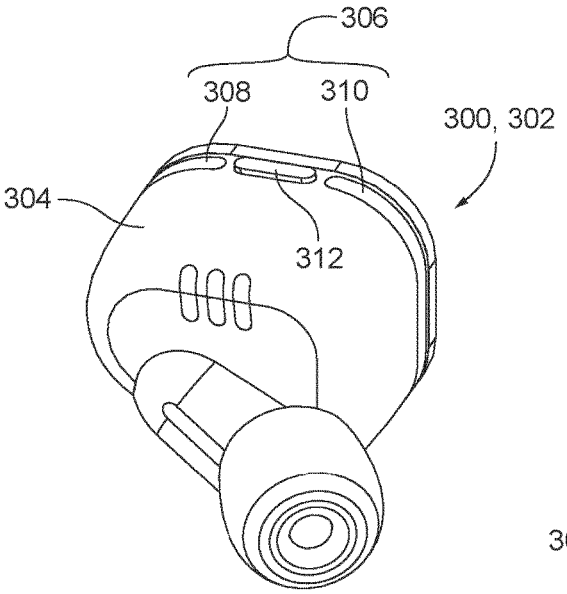
FIG. 9 is a front perspective view of an earpiece of a wearable audio device in accordance with another embodiment of the present technology.
Figure 10:
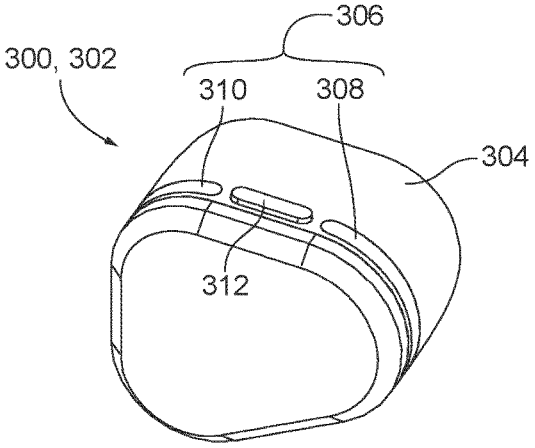
FIG. 10 is a back perspective view of the earpiece shown in FIG. 9.
Figure 11:
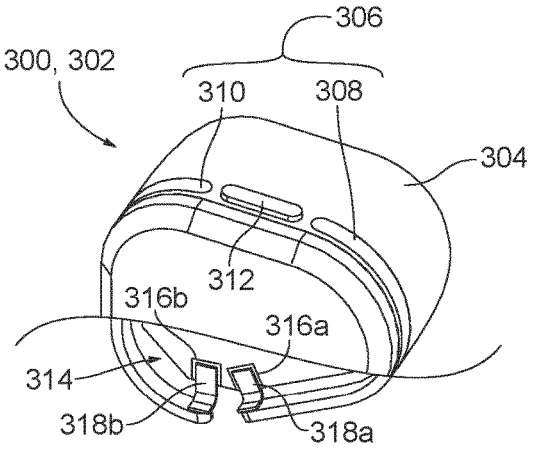
FIG. 11 is a back perspective view of the earpiece shown in FIG. 9 partially obscured to show internal components.

FIGS. 9 and 10 are, respectively, a front perspective view and a back perspective view of a portion of a wearable audio device 300 in accordance with another embodiment of the present technology. FIG. 11 is a back perspective view of the portion of the audio device 300 partially obscured to show internal components. With reference to FIGS. 9-11 together, the audio device 300 can include an earpiece 302 configured to be worn at a user's ear. For example, the earpiece 302 can be configured to be at least partially received within a concha of a user's ear when the user wears the audio device 300. In addition to the earpiece 302, the audio device 300 can include an opposite earpiece (not shown) having some or all of the features of the earpiece 302. The earpiece 302 can include a housing 304 containing a speaker (not shown). The audio device 300 can also include an antenna 306 conformably extending along a perimeter portion of the housing 304. In the illustrated embodiment, the antenna 306 is a dipole antenna including an independent positive antenna element 308 and an independent negative antenna element 310. In other embodiments, a counterpart of the antenna 306 can be a monopole antenna or an antenna of another suitable type. With reference again to FIGS. 9-11, the audio device 300 can include a button 312 at an exterior of the housing 304. The button 312 can be operable to turn the earpiece 302 on or off, to change a volume of sound from the speaker within the housing 304, and/or to cause another change in operation of the audio device 300.

As shown in FIG. 11, the audio device 300 can include a rigid circuit board 314 within the housing 304. The circuit board 314 can at least partially support processing circuitry configured to receive audio content via the antenna 306 over one or more short-range RF bands. The processing circuitry can also be configured to generate sound corresponding to the audio content via the speaker within the housing 304. As with the audio devices 100, 200 described above, audio content can travel within the audio device 300 from the antenna 306 to the circuit board 314 without travelling through any flexible wires. The circuit board 314 can include antenna contacts 316 (individually identified as antenna contacts 316*a*, 316*b*) through which the antenna 306 is electrically connected to the processing circuitry. The audio device 300 can include angled plates 318 (individually identified as angled plates 318*a*, 318*b*) electrically connecting the positive and negative antenna elements 308, 310, respectively, and the circuit board 314 via the antenna contacts 316*a*, 316*b*, respectively. The angled plate 318*a* can be resilient and either fixedly connected to the antenna 306 and resiliently pressed against the antenna contact 316*a* or fixedly connected to the antenna contact 316*a* and resiliently pressed against the antenna 306. Similarly, the angled plate 318*b* can be resilient and either fixedly connected to the antenna 306 and resiliently pressed against the antenna contact 316*b* or fixedly connected to the antenna contact 316*b* and resiliently pressed against the antenna 306.

Figure 12:
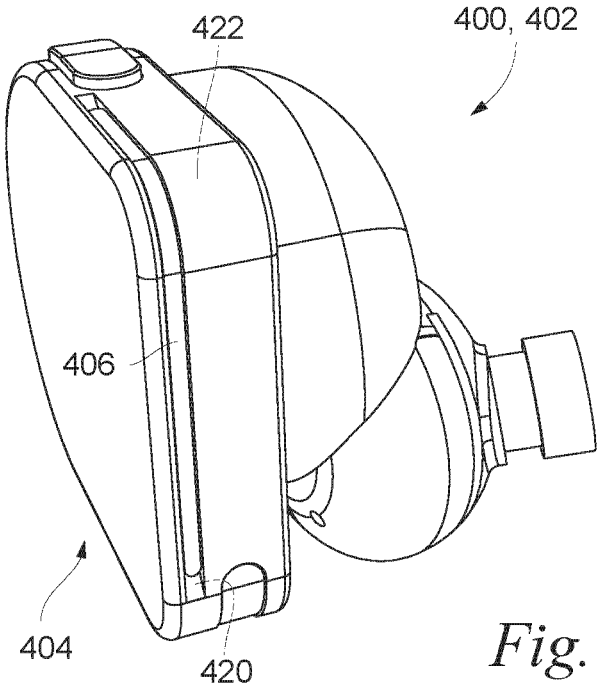
FIG. 12 is a front perspective view of a portion of a wearable audio device in accordance with another embodiment of the present technology.
Figure 13:
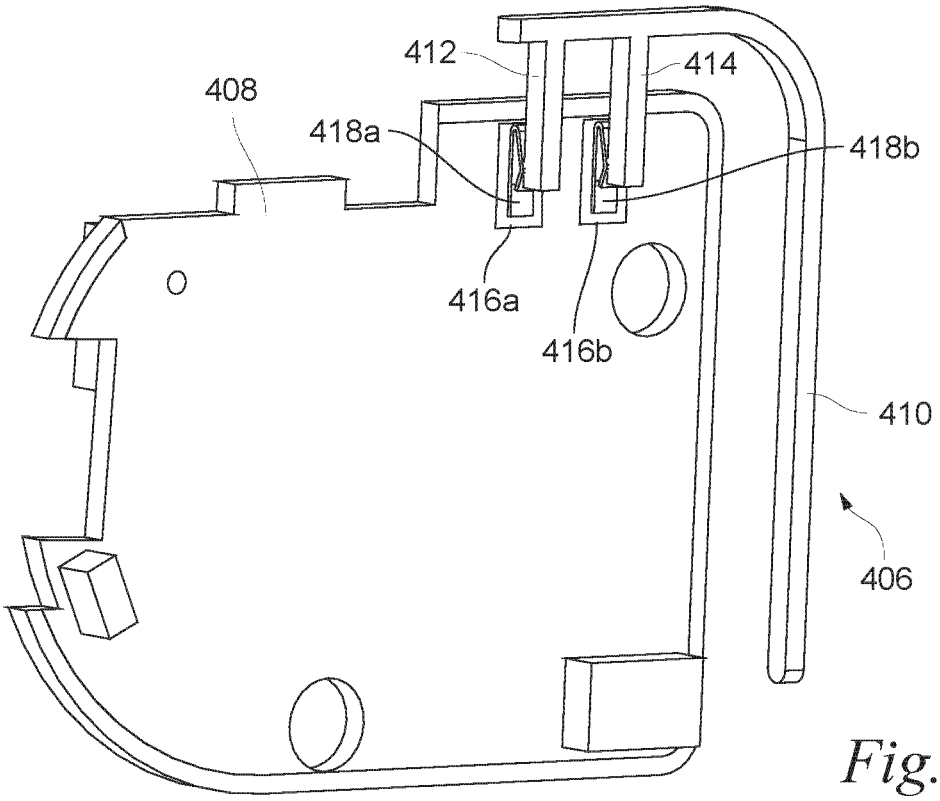
FIG. 13 is an enlarged perspective view of selected components of the portion of an audio device shown in FIG. 12.

FIG. 12 is a front perspective view of a portion of a wearable audio device 400 in accordance with another embodiment of the present technology. As shown in FIG. 12, the audio device 400 can include an earpiece 402 configured to be worn at a user's ear. For example, the earpiece 402 can be configured to be at least partially received within a concha of a user's ear when the user wears the audio device 400. In addition to the earpiece 402, the audio device 400 can include an opposite earpiece (not shown) having some or all of the features of the earpiece 402. The earpiece 402 can include a housing 404 containing a speaker (not shown). The audio device 400 can also include an antenna 406 conformably extending along a perimeter portion of the housing 404. FIG. 13 is an enlarged perspective view of the antenna 406 and associated components of the audio device 400.

With reference to FIGS. 12 and 13 together, the audio device 400 can include a rigid circuit board 408 within the housing 404. The antenna 406 can be a planar inverted-F antenna or another suitable type. As shown in FIG. 13, the antenna 406 can include a main antenna element 410 spaced apart from and in approximately the same plane as the circuit board 408. For example, the main antenna element 410 can be parallel to and laterally offset from a leading edge of the circuit board 408. The antenna 406 can also include a shorting line 412 and a feed line 414 each extending between the main antenna element 410 and the circuit board 408. The circuit board 408 can carry a ground plane (not shown) electrically connected to the main antenna element 410 via the shorting line 412, and circuitry (also not shown) electrically connected to the main antenna element 410 via the feed line 414. As with the audio devices 100, 200, 300 described above, audio content can travel within the audio device 400 from the antenna 406 to the circuit board 408 without travelling through any flexible wires. The circuit board 408 can include antenna contacts 416 (individually identified as antenna contacts 416*a*, 416*b*) through which the antenna 406 is electrically connected to the ground plane and the circuitry, respectively. The audio device 400 can include spring-plate contacts 418 (individually identified as spring-plate contacts 418*a*, 418*b*) electrically connecting the antenna contacts 416*a*, 416*b* to the antenna 406 via the shorting line 412 and the feed line 414, respectively.

As shown in FIG. 12, the housing 404 can include a groove 420 in which the main antenna element 410 is conformably received. When the earpiece 402 is operably positioned in a user's ear (not shown), the groove 420 and the main antenna element 410 can be at least primarily at anterior and superior portions of the housing 404. Relatedly, the groove 420 and the main antenna element 410 can conformably extend along an anteriormost and superiormost corner 422 of the housing 404. Furthermore, at least 75% of a total exposed surface area of the antenna 406 can be at an anterior side of a vertical plane that exactly bisects the earpiece 402 or is horizontally offset from exactly bisecting the earpiece by less than 10% of a total width of the earpiece 402. These features of the position of the antenna 406 may reduce the effect of common sources of interference and variability, thereby enhancing short-range RF communication fidelity.

The antenna 406, the spring-plate contacts 418, and counterparts of these components can be well suited for implementation both in compact earpieces, such as the earpiece 402, and in non-compact earpieces, such as standard-size over-ear and on-ear earpieces. For example, with reference to FIGS. 5 and 13 together, a counterpart of the audio device 100 can include a planar inverted-F antenna rather than a dipole antenna. In that case, the positive antenna element 118 can be replaced with a counterpart of the main antenna element 410. Furthermore, the circuit board 130, the leads 132, and the antenna contacts 134 can be replaced with counterparts of the circuit board 408, the spring-plate contacts 418, and the antenna contacts 416, respectively.

This disclosure is not intended to be exhaustive or to limit the present technology to the precise forms disclosed herein. Although specific embodiments are disclosed herein for illustrative purposes, various equivalent modifications are possible without deviating from the present technology, as those of ordinary skill in the relevant art will recognize. In some cases, well-known structures and functions have not been shown and/or described in detail to avoid unnecessarily obscuring the description of the embodiments of the present technology. Although steps of methods may be presented herein in a particular order, in alternative embodiments the steps may have another suitable order. Similarly, certain aspects of the present technology disclosed in the context of particular embodiments may be combined or eliminated in other embodiments. Furthermore, while advantages associated with certain embodiments may have been disclosed in the context of those embodiments, other embodiments may also exhibit such advantages, and not all embodiments need necessarily exhibit such advantages or other advantages disclosed herein to fall within the scope of the present technology.

Throughout this disclosure, the singular terms "a," "an," and "the" include plural referents unless the context clearly indicates otherwise. Similarly, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the terms "comprising" and the like, as used throughout this disclosure, mean including at least the recited feature(s) such that any greater number of the same feature(s) and/or one or more additional types of features are not precluded. Directional terms, such as "upper," "lower," "front," "back," "vertical," and "horizontal," may be used herein to express and clarify the relationship between various elements. It should be understood that such terms do not denote absolute orientation. Reference herein to "one embodiment," "an embodiment," or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments of the present technology.

I claim:

1. A wearable audio device, comprising:

an earpiece including a housing and a speaker within the housing;

an exposed antenna conformably extending along a perimeter portion of the housing;

processing circuitry within the housing, wherein the processing circuitry is configured to receive audio content via the antenna, and wherein the processing circuitry is configured to generate sound corresponding to the audio content via the speaker;

a rigid circuit board within the housing, wherein the circuit board supports at least some of the processing circuitry, and wherein the circuit board includes an antenna contact; and an angled plate electrically connecting the antenna and the circuit board via the antenna contact, wherein the angled plate either is fixedly connected to the antenna and resiliently pressed against the antenna contact or is fixedly connected to the antenna contact and resiliently pressed against the antenna.

2. The wearable audio device of claim 1 wherein the antenna is a monopole antenna.

3. The wearable audio device of claim 1 wherein the antenna is a dipole antenna including independent positive and negative antenna elements.

4. The wearable audio device of claim 3 wherein the positive and negative antenna elements are disposed at opposite respective sides of a horizontal plane that exactly bisects the earpiece or is vertically offset from exactly bisecting the earpiece by less than 10% of a total height of the earpiece when a user wears the audio device.

5. The wearable audio device of claim 3 wherein at least 75% of a total exposed surface area of the antenna is at one or the other side of a vertical plane that exactly bisects the earpiece or is horizontally offset from exactly bisecting the earpiece by less than 10% of a total width of the earpiece when a user wears the audio device.

6. The wearable audio device of claim 1 wherein the earpiece is configured to cover at least half of a user's ear when the user wears the audio device.

7. The wearable audio device of claim 1 wherein the earpiece is configured to be at least partially received within a concha of a user's ear when the user wears the audio device.

8. The wearable audio device of claim 7 wherein the antenna is a planar inverted-F antenna.

9. The wearable audio device of claim 7 wherein:

the housing has an anteriormost and superiormost corner when the user wears the audio device; and the antenna conformably extends along the corner.

10. The wearable audio device of claim 7 wherein at least 75% of a total exposed surface area of the antenna is at an anterior side of a vertical plane that exactly bisects the earpiece or is horizontally offset from exactly bisecting the earpiece by less than 10% of a total width of the earpiece when the user wears the audio device.

11. A wearable audio device, comprising:

an earpiece configured to be at least partially received within a user's ear canal when the user wears the audio device, wherein the earpiece includes a first housing and a speaker within the first housing;

a second housing positioned to be below the earpiece when the user wears the audio device in a hands-free state;

a flexible cord extending between the earpiece and the second housing;

an exposed antenna conformably extending along a perimeter portion of the second housing;

processing circuitry within the second housing, wherein the processing circuitry is configured to receive audio content via the antenna, and wherein the processing circuitry is configured to generate sound corresponding to the audio content via the cord and via the speaker;

a rigid circuit board within the housing, wherein the circuit board supports at least some of the processing circuitry, and wherein the circuit board includes an antenna contact; and an angled plate electrically connecting the antenna and the circuit board via the antenna contact, wherein the angled plate either is fixedly connected to the antenna and resiliently pressed against the antenna contact or is fixedly connected to the antenna contact and resiliently pressed against the antenna.

12. The wearable audio device of claim 11 wherein the antenna is a monopole antenna.

13. The wearable audio device of claim 11 wherein the antenna is a dipole antenna including independent positive and negative antenna elements.

14. A wearable audio device, comprising:

a housing;

an antenna conformably extending along a perimeter portion of the housing;

processing circuitry within the housing, wherein the processing circuitry is configured to receive audio content via the antenna;

a rigid circuit board within the housing, wherein the rigid circuit board supports at least some of the processing circuitry and includes an antenna contact; and an angled plate electrically connecting the antenna and the rigid circuit board via the antenna contact;

wherein the audio content travels from the antenna to the rigid circuit board without travelling through any flexible wires and the angled plate either is fixedly connected to the antenna and resiliently pressed against the antenna contact or is fixedly connected to the antenna contact and resiliently pressed against the antenna.

15. The wearable audio device of claim 14 wherein the antenna is a monopole antenna.

16. The wearable audio device of claim 14 wherein the antenna is a dipole antenna including independent positive and negative antenna elements.

17. A wearable audio device, comprising:

an earpiece including a housing and a speaker within the housing;

an exposed antenna conformably extending along a perimeter portion of the housing, wherein the antenna is not a loop antenna;

processing circuitry within the housing, wherein the processing circuitry is configured to receive audio content via the antenna, and wherein the processing circuitry is configured to generate sound corresponding to the audio content via the speaker;

a rigid circuit board within the housing, wherein the circuit board supports at least some of the processing circuitry, and wherein the circuit board includes an antenna contact; and a pin connector electrically connecting the antenna and the circuit board via the antenna contact, wherein the pin connector includes a pin and a spring configured to resiliently urge the pin from a retracted position toward an extended position.

18. A wearable audio device, comprising:

an earpiece including a housing and a speaker within the housing;

an exposed antenna conformably extending along a perimeter portion of the housing, wherein the antenna is not a loop antenna;

processing circuitry within the housing, wherein the processing circuitry is configured to receive audio content via the antenna, and wherein the processing circuitry is configured to generate sound corresponding to the audio content via the speaker;

a flexible circuit board within the housing, wherein the circuit board supports at least some of the processing circuitry, and wherein the circuit board includes an antenna contact; and a rigid lead extending between the antenna and the circuit board, wherein the antenna contact is clamped to the lead.

19. The wearable audio device of claim 18 wherein:

the earpiece includes— a pad positioned to be between the housing and a user's ear when the user wears the audio device, and a rigid plate between the speaker and the pad; and the antenna contact is clamped between the plate and the lead.

20. A wearable audio device, comprising:

an earpiece configured to be at least partially received within a user's ear canal when the user wears the audio device, wherein the earpiece includes a first housing and a speaker within the first housing;

a second housing positioned to be below the earpiece when the user wears the audio device in a hands-free state;

a flexible cord extending between the earpiece and the second housing;

an exposed antenna conformably extending along a perimeter portion of the second housing, wherein the antenna is not a loop antenna;

processing circuitry within the second housing, wherein the processing circuitry is configured to receive audio content via the antenna, and wherein the processing circuitry is configured to generate sound corresponding to the audio content via the cord and via the speaker;

a rigid circuit board within the second housing, wherein the circuit board supports at least some of the processing circuitry, and wherein the circuit board includes an antenna contact; and a pin connector electrically connecting the antenna and the circuit board via the antenna contact, wherein the pin connector includes a pin and a spring configured to resiliently urge the pin from a retracted position toward an extended position.

21. A wearable audio device, comprising:

a housing;

an antenna conformably extending along a perimeter portion of the housing;

processing circuitry within the housing, wherein the processing circuitry is configured to receive audio content via the antenna;

a rigid circuit board within the housing, wherein the rigid circuit board supports at least some of the processing circuitry and includes an antenna contact; and a pin connector electrically connecting the antenna and the rigid circuit board via the antenna contact, the pin connector including a pin and a spring configured to resiliently urge the pin from a retracted position toward an extended position, wherein the audio content travels from the antenna to the rigid circuit board without travelling through any flexible wires.

22. A wearable audio device, comprising:

a housing;

an antenna conformably extending along a perimeter portion of the housing;

processing circuitry within the housing, wherein the processing circuitry is configured to receive audio content via the antenna;

a flexible circuit board within the housing, wherein the flexible circuit board supports at least some of the processing circuitry and includes an antenna contact; and a rigid lead extending between the antenna and the flexible circuit board, wherein the audio content travels from the antenna to the flexible circuit board without travelling through any flexible wires and the antenna contact is clamped to the rigid lead.

23. A wearable audio device, comprising:

an earpiece configured to be at least partially received within a user's ear canal when the user wears the audio device, wherein the earpiece includes a first housing and a speaker within the first housing;

a second housing;

a flexible cord extending between the earpiece and the second housing, an antenna conformably extending along a perimeter portion of the second housing;

processing circuitry within the second housing, wherein the processing circuitry is configured to receive audio content via the antenna;

a circuit board within the housing, wherein the circuit board supports at least some of the processing circuitry, wherein the audio content travels from the antenna to the circuit board without travelling through any flexible wires, wherein the circuitry is configured to generate sound corresponding to the audio content via the cord and via the speaker, and wherein the second housing is positioned to be below the earpiece when the user wears the audio device in a hands-free state.

24. A wearable earpiece audio device, comprising:

a housing;

a speaker within the housing;

an antenna conformably extending along a perimeter portion of the housing;

processing circuitry within the housing, wherein the processing circuitry is configured to receive audio content via the antenna;

a flexible circuit board within the housing, wherein the flexible circuit board supports at least some of the processing circuitry and includes an antenna contact;

a pad positioned to be between the housing and a user's ear when the user wears the earpiece audio device;

a rigid plate between the speaker and the pad; and a rigid lead extending between the antenna and the flexible circuit board, wherein the audio content travels from the antenna to the flexible circuit board without travelling through any flexible wires, wherein the processing circuitry is configured to generate sound corresponding to the audio content via the speaker, and wherein the antenna contact is clamped between the rigid plate and the rigid lead.

25. The wearable earpiece audio device of claim 24 wherein the earpiece audio device is configured to cover at least half of a user's ear when the user wears the earpiece audio device.

26. The wearable earpiece audio device of claim 24 wherein the earpiece audio device is configured to be at least partially received within a concha of a user's ear when the user wears the earpiece audio device.

* * * * *